US008286813B2

(12) United States Patent
Eklund

(10) Patent No.: US 8,286,813 B2
(45) Date of Patent: Oct. 16, 2012

(54) HANDLE WITH A CLOSURE FUNCTION, CONNECTABLE TO A BOTTLE

(76) Inventor: Tore Eklund, Motala (SE)

( * ) Notice: Subject to any disclaimer, the term of this patent is extended or adjusted under 35 U.S.C. 154(b) by 403 days.

(21) Appl. No.: 12/597,703

(22) PCT Filed: Apr. 28, 2008

(86) PCT No.: PCT/SE2008/050482

§ 371 (c)(1),
(2), (4) Date: Oct. 26, 2009

(87) PCT Pub. No.: WO2008/133591

PCT Pub. Date: Nov. 6, 2008

(65) Prior Publication Data

US 2010/0133226 A1 Jun. 3, 2010

(30) Foreign Application Priority Data

Apr. 26, 2007 (SE) ..... 0701000

(51) Int. Cl.

| | |
|---|---|
| ***B65D 41/00*** | (2006.01) |
| ***B65D 47/00*** | (2006.01) |
| ***B65D 41/02*** | (2006.01) |
| ***B65D 43/26*** | (2006.01) |
| ***B65D 51/04*** | (2006.01) |

(52) U.S. Cl. ..... 215/239; 215/235; 215/240; 215/241; 215/242; 215/305; 220/260; 220/262; 220/846

(58) Field of Classification Search ..... 215/235, 215/239, 240, 241, 242, 305; 220/260, 262, 220/846

See application file for complete search history.

(56) References Cited

U.S. PATENT DOCUMENTS

| | | | | |
|---|---|---|---|---|
| 3,809,300 | A * | 5/1974 | Russell | 222/545 |
| 4,009,794 | A * | 3/1977 | Zapp | 215/210 |
| 4,776,501 | A * | 10/1988 | Ostrowsky | 222/517 |
| 5,065,877 | A | 11/1991 | Karppinen et al. | |
| 5,385,277 | A | 1/1995 | Drew et al. | |

FOREIGN PATENT DOCUMENTS

| | | |
|---|---|---|
| EP | 0 320 191 | 6/1989 |

(Continued)

OTHER PUBLICATIONS

International Search Report dated Aug. 7, 2008, from corresponding PCT application.

*Primary Examiner* — Anthony Stashick
*Assistant Examiner* — Madison L Wright
(74) *Attorney, Agent, or Firm* — Young & Thompson

(57) ABSTRACT

A device to be detachably mounted on the neck of a bottle in replacement of the bottle's screw cap, and which as mounted provides a reversible closure function by which a flow communication to the interior of the bottle is shifted between open and closing modes, the device including a mounting part (1; 1'; 1") having an internal thread which engages an external thread formed on the bottle's neck, and a handle (7; 7'; 7") which is journalled in the mounting part for rotation. The handle carries a head (9; 9'; 9") which in result of rotation of the handle upwards/outwards from the bottle in a vertical plane provides access to the mouth of a canal (15; 15'; 15") running through the mounting part, and which head further includes a seal (17; 17'; 36) which, in result of rotation of the handle downwards/inwards towards the bottle, is positioned for closing the canal through the mounting part.

16 Claims, 2 Drawing Sheets

FOREIGN PATENT DOCUMENTS

Figure 1:
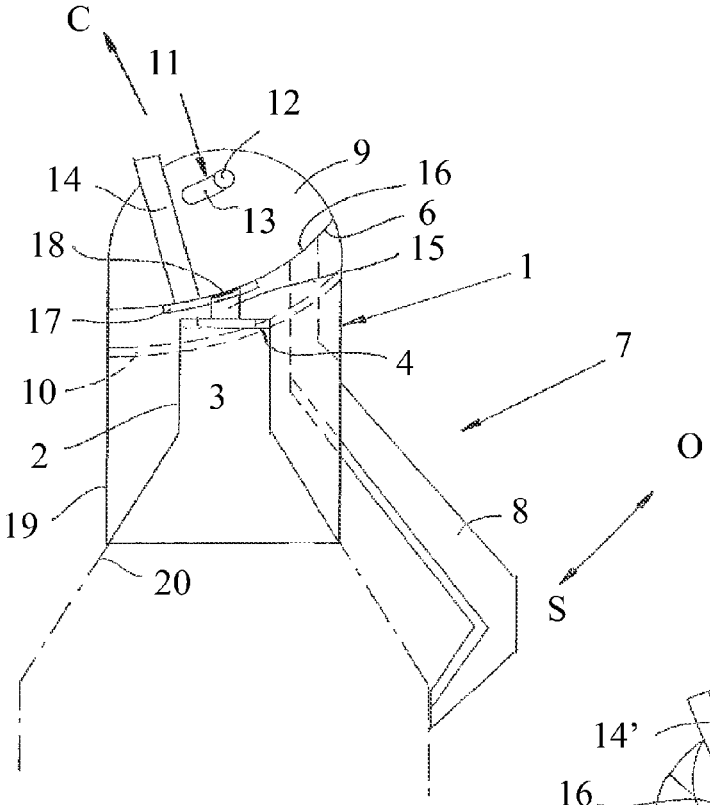

| | | |
|---|---|---|
| EP | 0 670 269 | 9/1995 |
| JP | 2002-068198 | 3/2002 |
| JP | 2002-240828 | 8/2002 |
| SE | 464 809 | 6/1991 |

* cited by examiner

HANDLE WITH A CLOSURE FUNCTION, CONNECTABLE TO A BOTTLE

TECHNICAL FIELD OF THE INVENTION

The present invention relates to handles which are detachably connectable to the neck of a bottle. More specifically, the invention relates to such a handle which provides a reversible closure function in replacement of the bottle's original screw cap when the handle is mounted to the bottle.

BACKGROUND AND PRIOR ART

The majority of plastic bottles that are sold containing beverages have a neck with an outer thread onto which a screw cap can be mounted. Even if the beverages are of separate origin the bottles often have corresponding screw threads, such that the screw thread can be regarded as having achieved a degree of standardization. Another property in plastic bottles is due to a resiliency which results in a problem of holding the bottles, especially when they are reduced of their content. This problem is readily notable in bottles of larger volumes, and in bottles of reduced wall thickness. Since a clear trend is to increase the bottle volume while reducing the wall thickness for reasons of environmental care and production costs, there is a growing desire and problem to provide a stable grip about the bottle when pouring its beverage content.

Several suggestions for a handle arranged to be detachably connected to a plastic bottle are found in the patent literature. EP-B-0 670 269 and JP-A-2000 43878 both disclose a handle which is detachably mountable to the neck of a plastic bottle. None of these handles however discloses a closure function in replacement of the original screw cap.

From U.S. Pat. No. 5,385,277 a handle with a closure function is previously known for bottles containing carbonized beverage. This handle comprises a first handle part which can be mounted on the bottle neck by aid of a separate adapter, when the screw cap is removed. The separate adapter has a central opening that provides access to the mouth of the bottle. A second handle part is pivotally connected to the first handle part, and encloses the latter on three sides in a way that both handle parts are gripped by the user's hand when the bottle is lifted. A horizontal pivot axis extends through both handle parts. The second, outer handle part comprises an angled upper portion extending above the bottle opening. From this upper portion, a plug inserts into the bottle mouth when the handle is inactivated. When a force is applied to the handle from a hand gripping the handle, the handle parts are squeezed together upon which the angled upper portion and the plug are pivoted upwards, freeing the bottle mouth such that beverage can be poured out from the bottle via a spout which extends from the bottle opening from the first, stationary part of the handle. Closing of the bottle mouth is achieved by pressing, with the hand, the angled upper portion with the plug arranged in its lower side down towards the bottle mouth.

This prior art handle contains several parts included in a comparatively complex structure, and is for this reason rather expensive both in production and assembly. The structure is also rather space consuming since the movable handle parts are interconnected in a pivot joint which is positioned radially away from the bottle centre. Specifically, an unintentional opening of the bottle can not be prevented if the handle gets into a squeeze during transport and storage, since any force applied from outside towards the bottle inevitably results in the plug being pivoted out from the bottle's mouth.

SUMMARY OF THE INVENTION

The present invention thus aims to provide a handle with a closure function connectable to a bottle, the handle having a non-complex structure which can be produced and assembled at low cost.

Another object is to provide a handle with a closure function connectable to a bottle, the handle having small dimensions and which requires only moderated storage space when mounted on a bottle.

Still another object is to provide a handle with a closure function connectable to a bottle and arranged to prevent an unintentional opening of the bottle in case the bottle becomes squeezed, e.g.

One or several of these objects are met in a device as specified in the appended claims.

Briefly, according to the invention, there is provided a device which is detachably connected to the neck of a bottle in replacement of the bottle's screw cap, and which in the mounted position provides a reversible closure function by which the flow communication with the bottle interior is shiftable between open and closed conditions, the device comprising a mounting part having an internal thread which engages an outer thread formed on the bottle neck, and a handle which is pivotally connected to the mounting part. A characterizing feature of the device is that the handle carries a head which, in result of the handle being rotated upwards/outwards from the bottle in a vertical plane, opens the mouth of a canal through the mounting part, the head further comprising a seal which in result of the handle being rotated downwards/inwards towards the bottle is positioned for closing said canal through the mounting part.

A locking ratchet is preferably arranged to act between the mounting part and the handle, effective in a locking mode to prevent the handle from rotation in relation to the mounting part.

The handle further comprises an elongate hole by which the handle is displaceable on a pivot arranged on the mounting part, about which pivot the handle is rotatable between open and closed positions.

Advantageously, the locking ratchet is arranged with a lever which, as the ratchet is locked in the closing position, displaces the handle on the pivot and this way urges the head into a sealing abutment with the mouth of the canal running through the mounting part.

In a preferred embodiment the handle comprises two legs which extend on opposite side of the mounting part, and which in their outer ends are interconnected via an end-piece having a recess formed in the side thereof facing the mounting part. In the closing position, an edge protruding from the canal's mouth on the mounting part is receivable in said recess. An elastic seal element can be arranged in the bottom of the recess.

The end-piece on the handle's head comprises a cut out opening in the edge of the end-piece. This cut out can be arranged to rest against the protruding edge in order to form a spout for pouring in the opened mode of the handle.

Another embodiment foresees, that the canal through the mounting part is arranged to mouth in an arcuate surface formed on the mounting part, whereas a canal through the handle's head is arranged to mouth in an opposite arcuate surface formed on the head. These canal mouths are brought in alignment in result of rotating the handle head relative to the mounting part in a first direction along the interface formed between the two arcuate surfaces, whereas rotation in the opposite direction closes the flow communication over the mouths.

The movability of the handle is preferably limited in both directions of movement, i.e. towards the open as well as towards the closed position, to which purpose rotation limiting means are arranged to operate between the handle and the mounting part.

In order to have a stable anchoring of the device on the bottle, the mounting part preferably comprises a portion hanging down to be supported by the conical upper portion of the bottle when the handle is mounted on the bottle neck.

Further embodiments and advantageous details of the invention will appear from the detailed description below, and from the appended claims.

SHORT DESCRIPTION OF THE DRAWINGS

Figure 2:
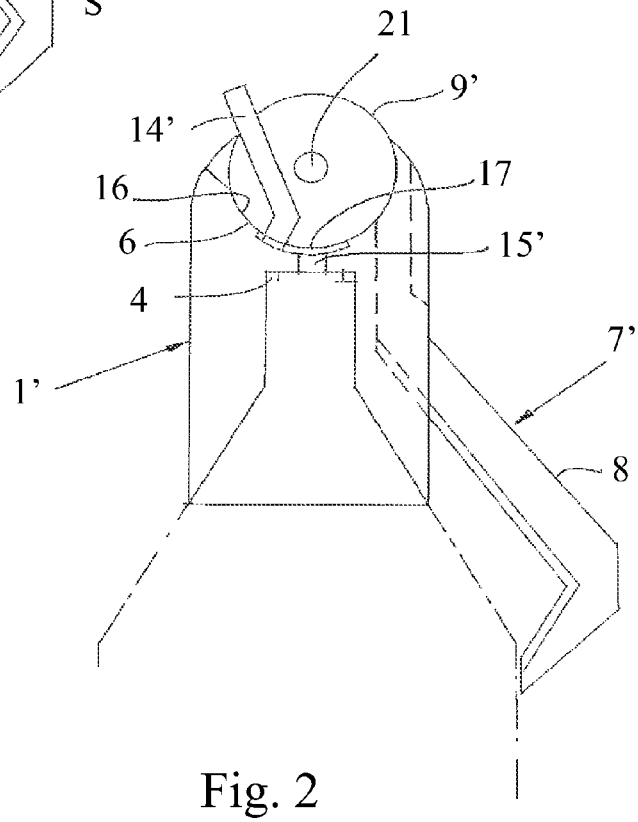
Figures 3A, 3B, 3C:
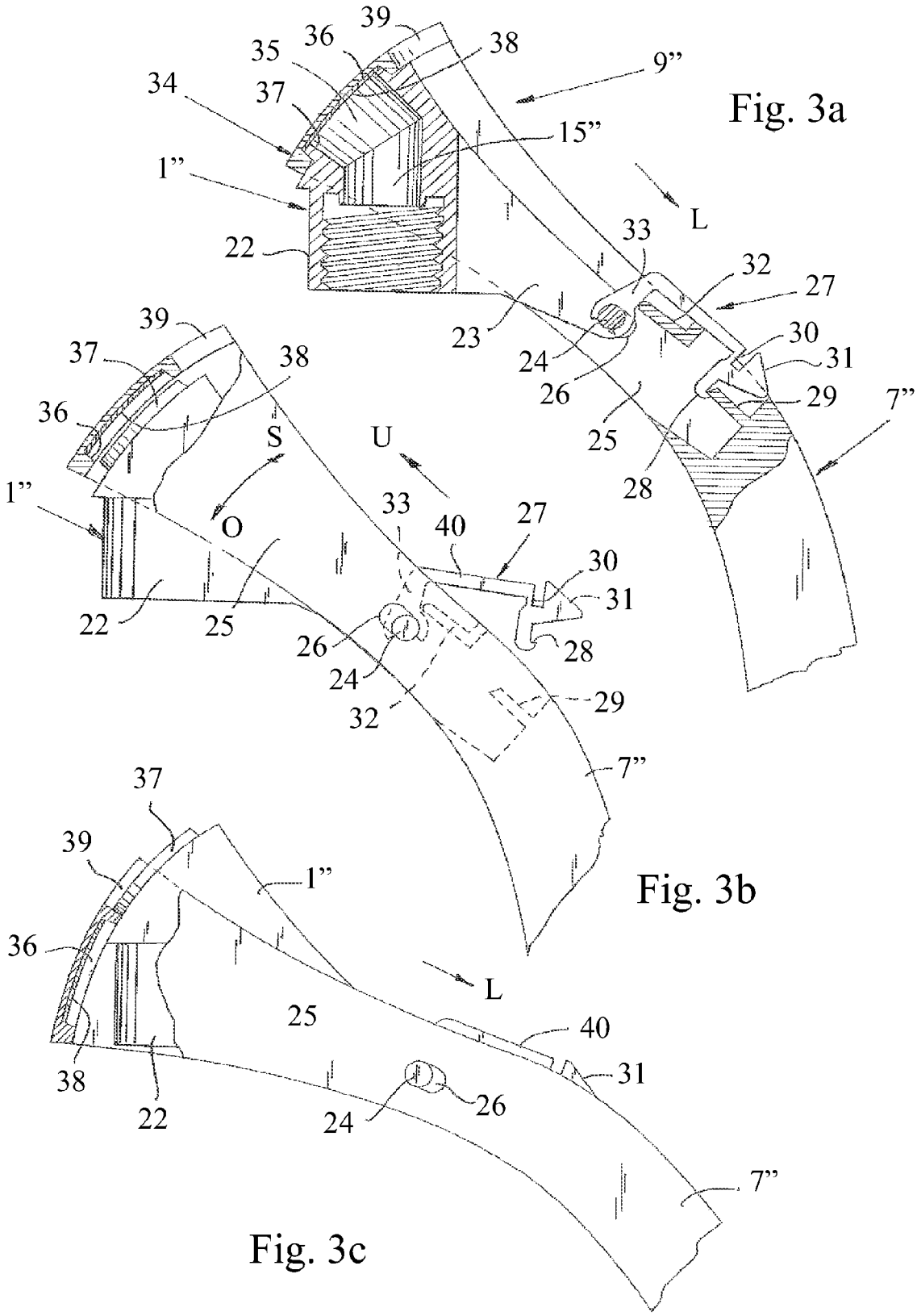

The invention is more closely explained below with reference made to the attached drawings, schematically illustrating embodiments of the invention. In the drawings, FIG. 1 is a schematic elevation view of a first embodiment of the invention;

FIG. 2 is a corresponding schematic elevation view of a second embodiment of the invention;

FIG. 3*a* is a partially sectioned and broken away elevation view showing a preferred embodiment in a closed and locked position;

FIG. 3*b* shows the embodiment of FIG. 3*a* in unlocked position for opening the flow communication to the bottle interior, and FIG. 3*c* shows this embodiment in an opened mode.

DETAILED DESCRIPTION OF EMBODIMENTS

With reference to FIG. 1 there is schematically shown a first embodiment of a device comprising a mounting part 1 having an internal thread 2 to be mounted on the external thread of a bottle's neck 3. A ring-shaped seal 4 is advantageously carried on the mounting part so as to provide a sealed connection against the opening end of the bottle neck. From the latter, a canal reaches through the mounting part 1 to mouth in an arcuate upper surface 6 formed on the mounting part 1.

A handle 7 is movably journalled in the mounting part 1. The handle 7 comprises an elongate shaft providing a grip 8. An upper end of the grip 8 connects to a head 9. The grip 8 and head 9 may be formed integrally from one piece of material, and may alternatively comprise separate elements that are arranged to be interconnected and mutually journalled in the mounting part 1 for rotation. In another alternative, the grip 8 and head 9 can be arranged to be separately journalled in the mounting part 1, whereby at least the handle's head 9 forms a part of the handle 7 that is movably arranged on the mounting part. Advantageously, at least the head 9 has an outer shape which is supplementary to the shape of the mounting part.

The handle 7, comprising the grip 8 and the head 9, is displaceable in relation to the mounting part by being guided along an arcuate slide path 10. In order to facilitate displacement of the handle along the slide path 10, a support 11 can be arranged in the form of a pivot 12 which is arranged on the handle or on the mounting part, and which is arranged to run inside an arcuate slot 13 formed on the handle or on the mounting part. The slot 13 and slide path 10 has a common geometric centre C located outside the handle, and on a level located above the mouth of the bottle. A canal 14 is formed through the handle, and more precisely through the handle's head 9. Without being illustrated, and for completeness of the description, it should be mentioned that the canal 14 as known per se can be associated with an air passage which can be arranged to run in the direction of the canal 14.

The canal 14 mouths on one hand on the outside of the handle's head 9, and on the other hand in a lower arcuate surface 16 of substantially equal radius as the upper surface 6 of the mounting part. In the interconnected position of the handle and the mounting part, the surfaces 6 and 16 form an arcuate interface 6, 16 between the mounting part and the handle. The circle centre for the interface 6, 16 coincides with the centre for the slide path 10. At least one separate seal element 17 can be arranged at the mouths in this interface, and is preferably lowered into one of the arcuate surfaces 6 or 16, respectively. Formations such as protrusions 18 may be arranged in at least one of the surfaces 6 or 16 to provide a sealing interaction with the seal element 17.

In FIG. 1 the canal 15 through the mounting part is closed to fluid flow from the interior of the bottle. In result of displacing of the handle 7 relative to the mounting part 1 along the interface 6, 16 in direction of the arrow O, the mouths arranged at the interface 6, 16 are brought in alignment, this way opening the flow communication between the bottle's interior and the canal mouth in the outside of the handle. In result of a displacement in the opposite direction S, the flow communication is closed. Opening of the flow communication is thus accomplished by the handle 7 being rotated upwards/outwards from the bottle in a vertical plane, as the instinctive result from using the handle to lift the bottle when pouring the beverage. Closing of the flow communication is accomplished in result of an instinctive continuation of the motion of putting the bottle down, wherein the handle 7 is rotated downwards/inwards towards the bottle in the same vertical plane. The risk of involuntary opening and outflow of beverage and/or carbon dioxide is substantially reduced, since any force applied towards the handle from outside acts in the closing direction.

The movement of the handle along the interface 6, 16 is limited in respect of its length, and preferably in both directions of movement O, S in order to clearly define the open and closed positions. Suitable movement limiting means are, e.g., formations providing a snap lock function which as known per se can be arranged in contact surfaces between the handle and the mounting part. In order to withstand bending forces arising from lifting the bottle and pouring beverage from the bottle, supporting surfaces can appropriately be arranged to interact between the mounting part and the handle. These are preferably exaggerated in respect of their dimensions ion order to define the opened mode. For the same purpose, the mounting part may comprise a portion 19 hanging down for support against the conical upper portion 20 of the bottle, when the handle is mounted on the bottle's neck.

With reference to FIG. 2 an alternative embodiment is shown, which is different from the embodiment of FIG. 1 in respect of the journal of the handle in the mounting part. More precisely, the embodiment of FIG. 2 is lacking of a structure corresponding to slide path 10 of the first embodiment. A handle 7' is instead pivotally journalled in a mounting part 1' about a horizontal pivot axis 21, located above the mouth of the bottle. The separating interface is here realized through an arcuate seat in which a canal 15' through the mounting part 1' mouths to be brought in flow communication with a canal 14' through the handle head 9' upon a corresponding rotation of the handle 7' about the axis 21. Beside that, the overall function and structure essentially correspond with the previously described handle, and includes the interface 6, 16 of the first embodiment via which a canal, running through the mounting part and mouthing at the interface, the way already described, is brought in flow communication with a discharge canal running through the handle's head and mouthing at the interface and on the outside of the handle head, respectively.

A preferred embodiment of the invention will now be described with reference made to FIGS. 3*a*-3*c*. In the preferred embodiment, a handle 7" is pivotally journalled in a mounting part 1". The mounting part 1" is arranged with an internally threaded portion 22 which can be screwed down on the external thread of a bottle. Adjoining the threaded portion 22 is a portion protruding in a radial direction, in the illustrated embodiment shaped as an arm 23. The arm 23 can be formed by two arm sections running side by side. Two pivots 24 project from the arms about a common centre in the outer end of the arm, in opposite directions and transversely to the general extension of the arm. The arm 23, as well as the internally threaded portion 22, is received in a central opening formed in the handle 7", formed by two legs 25 running side by side outside of and past the mounting part 1", in a way described in more detail below. In the mounted position, each pivot 24 engages an elongate hole 26, respectively, formed in the legs 25 of the handle.

A locking ratchet 27 is pivotally supported on the arm 23. The ratchet 27 can be arranged to rotate about an axis which connects the pivots 24, and which is extending between the arm sections of the mounting part 1", or else is extending through a correspondingly formed recess in the arm 23. The ratchet 27 is formed from an elastic material and provides a pawl 28 which can be brought to engage under a notch 29 projecting into the space formed between the legs 25 of the handle. The pawl 28 is arranged on the ratchet 27 via a material portion 30 of reduced thickness, and can be urged out of engagement with the notch 29 in result of a pressure manually applied against a contact surface 31 which is connected to the pawl 28. In the locking mode shown in FIG. 3*a*, the ratchet 27 is pressed against a counter support 32 which is likewise arranged in the space between the legs 25 of the handle. More precisely, the ratchet 27 comprises a leg 33 acting as a lever arm which causes, in the locking mode, an outwards displacement of the handle 7" in the direction L of the arm and the handle, while sliding on the pivots 24. In this position, the handle is prevented from rotation about the pivots 24 in a way that will be explained below.

The outer ends of the handle's legs 25 are interconnected via an end-piece 34. The legs 25 and end-piece 34 form together a head 9" adjoining the handle. On its inner side facing the mounting part 1", the end-piece 34 is formed so as to abut in sealing contact a mouth 35 of a canal 15" running through the mounting part 1". The seal is accomplished by the force applied from the ratchet 27 which provides a lever action together with the counter support 32. Sealing elements can be provided at the interface between an arcuate inner face formed on the end-piece 34 and a corresponding arcuate outer face formed on the mounting part 1". It is preferred that the end-piece 34 on its inner face comprises a recess 36, into which a protrusion 37 rising from the mounting part 1" is received in the locking mode. This way, in order to rotate the handle 7", loosening of the ratchet 27 is required to allow the necessary inwards displacement of the handle 7" in the direction of the handle and arm 23 according to the arrow U of FIG. 3*b*, in result of which the protrusion 37 is brought out from engagement with the recess 36. The recess 36 is circular in the preferred embodiment, and the protrusion 37 is realized as a circular edge rising from the mouth on the mounting part, this edge in the locking being received in sealing engagement inside the periphery of the recess. An elastic sealing element 38 is advantageously arranged on the bottom of the recess 36 in order to ensure a gastight closure of the mounting part's canal mouth in the locking mode.

It shall finally be mentioned that the end-piece 34, in the area of its upper edge, can be formed with a cut-out 39 going the through the end-piece and opening in the edge thereof. The cut-out 39 is arranged for alignment with the mounting part's canal mouth in the opened mode of the handle. The cut-out 39 is advantageously semi-circular in shape in order to be supported by the outer side of the circular edge of the protrusion 37, and the cut-out may be arranged to provide a spout for pouring beverage from the bottle in the mode illustrated in FIG. 3*c*. In the opened mode shown in FIG. 3*c*, the ratchet 27 can again be brought into its locking mode, whereby the handle is fixed relative to the mounting part such that beverage can be safely discharged. The ratchet 27 comprises a press key 40 in its upper side for depressing the ratchet 27.

Feasible Modifications of the Illustrated Embodiments

Without being showed in the drawings it shall be noted that as an alternative for locking the handle in the opened mode by means of a ratchet 27, the mutually opposite faces of the end-piece 34 and the mounting part 1" can be formed to provide a reversible locking between said faces as the handle is rotated upwards/outwards in order to open the canal through the mounting part 1". The opposite faces of the end-piece and the mounting part may be arranged to be arrested in the opened mode through friction between frictional surfaces formed for this purpose, e.g., or by the action of engaging locking means such as heels or wedges. An embodiment is specifically to be foreseen wherein the end-piece 34 comprises a first portion on which is arranged the seal for sealing the canal mouth 35 on the mounting part. This first portion of the end-piece 34 adjoins at an angle a second portion, on which is arranged the cut-out 39 for discharge of beverage. The mounting part having the mouth 35 is arranged with an angle which in the opened mode coincides with the angle of the second portion of the end-piece, securing this way a supporting contact between the mounting part and the angular second portion of the end-piece, in the opened mode. The angles can be chosen for a frictional arrest or wedging action between the mounting part and the second portion of the end-piece, in the opened mode.

Moreover, the mounting part can be formed to have a radius in the outer side facing the end-piece. The opposite face of the end-piece is formed to have a first portion on which is arranged the seal for sealing the canal mouth 35 on the mounting part. This first portion of the end-piece adjoins a second portion on which is arranged the recess 39. At least the second portion of the end-piece has a radius corresponding to a radius in the mounting part. The radii of the mounting part and the end-piece are arranged with separate centres, of which at least one centre is displaced from the pivotal centre of the handle located in the pivot 24, and more precisely displaced to a position from where this subject centre is displaced as the handle is rotated outwards/upwards upon opening of the canal mouth 35. In result hereof, said radii and associated centres will overlap to provide an abutting contact between the mounting part and the end-piece in the opened mode of the device.

The angles and the centres of the radii in the end-piece and the mounting part can be chosen such, that a gap is formed between the mounting part and the end-piece as the handle is rotated inwards/downwards upon closing of the canal mouth 35, just before the handle is arrested in the direction L by action of the ratchet 27. Cleaning of the device is this way facilitated without requiring the handle to be separated from the mounting part.

It is further to be foreseen that the seal on the end-piece 34 may in the alternative be formed as a ring-shaped recess in which the circular edge of the protrusion 37, protruding about the canal mouth, is insertable in the closing mode. The edge and the ring-shaped recess can provide bevelled or conical sectional profiles which promote the alignment between the edge and the recess upon closure of the device. It is alternatively foreseen that the seal comprises a cup-shaped recess, inside the periphery of which an edge of thinner material runs circumferentially, such that the edge under slight deformation is inserted into the canal mouth, in the closing mode. A corresponding sealing edge of thinner material, providing a corresponding function, can be arranged above the thread formed in the canal 15" through the mounting part, so as to project sealingly into the mouth of the bottle neck as the device is mounted on the bottle.

The embodiments disclosed above are all encompassed by the invention as defined in the appended claims, the same likewise encompassing other modifications of details in these embodiments which do not part from the basic solution which is explained by help of the above examples.

The invention claimed is:

1. A device detachably mounted on a neck of a bottle for replacing a screw cap of the bottle, and which as mounted provides a reversible closure function by which a flow communication to an interior of the bottle is shifted between an open mode and a closing mode, the device comprising:

a mounting part having an internal thread configured to engage an external thread formed on the a neck of the bottle;

a handle journalled for rotation in the mounting part, the handle comprising a head which in result of rotation of the handle upwards/outwards from the bottle in a vertical plane provides access to a mouth of a canal running through the mounting part, the head further comprising a seal which, in result of rotation of the handle downwards/inwards towards the bottle, is positioned for closing said canal through the mounting part; and a ratchet configured to act between the mounting part and the handle, the ratchet configured to prevent the handle from rotation relative to the mounting part in the closing mode.

2. The device according to claim 1, wherein the handle is formed with an elongate hole by which the handle is journalled for displacement on a pivot arranged on the mounting part, the handle being rotatable about the pivot between open and closing positions.

3. The device according to claim 2, wherein the ratchet is arranged with a lever arm by which the handle in the closing mode is displaced on the pivot for urging the head into sealing contact with the mouth of the canal through the mounting part.

4. The device according to claim 1, wherein the handle comprises an end-piece, said end-piece located at a side of the handle which faces the mounting part having a recess which receives in the closing mode an edge protruding from the mouth of the canal on the mounting part.

5. The device according to claim 4, wherein an elastic sealing element is arranged in a bottom of the recess.

6. The device according to claim 4, wherein the recess is ring-shaped.

7. The device according to claim 4, wherein the end-piece comprises a cut-out opening in an edge of the end-piece, said cut-out supported by said edge to form a spout in the open mode of the handle.

8. The device according to claim 4, wherein the end-piece comprises a first portion on which is arranged the seal for sealing the mouth of the canal on the mounting part, said first portion adjoining a second portion on which is arranged a cut-out for discharge of beverage, and wherein the mounting part with the mouth of the canal is arranged at an angle and/or a radius which in the opened mode coincides with an angle and/or a radius of the second portion of the end-piece.

9. The device according to claim 1, wherein a first mouth of the canal through the mounting part opens in an arcuate surface formed on the mounting part, and a second mouth of the canal through the head opens in an opposite arcuate surface formed on the head, and wherein the first and second mouths of the canal are brought in mutual alignment in result of rotating the head relative to the mounting part in a direction (O) along an interface which is formed between the arcuate surfaces, whereas rotation of the head in an opposite direction (S) closes a flow connection.

10. The device according to claim 1, wherein the handle is journalled for rotation on the mounting part about a horizontal axis, the horizontal axis running through both the handle and the mounting part.

11. The device according to claim 9, wherein the handle is journalled for rotation on the mounting part about a pivot which is displaceable in engagement with the head of the handle through an arcuate slot, a geometric centre of the arcuate slot being located outside the mounting part.

12. The device according to claim 9, wherein the handle is journalled for displacement in an arcuate slide path arranged in the mounting part, a geometric centre (C) of the slide path being located outside the mounting part.

13. The device according to claim 9, wherein the axis is located above a mouth of the bottle.

14. The device according to claim 9, wherein at least one separate sealing element is inserted at an interface between the mounting part and the handle, said sealing element being lowered into the arcuate surface of the mounting part or of the handle.

15. The device according to claim 1, wherein an capability of the handle for rotation in a rotational direction (O, S) is limited by rotation limiting means arranged on the mounting part and/or arranged on the handle.

16. The device according to claim 1, wherein the mounting part comprises a portion hanging down for support by a conical upper part of the bottle as the device is mounted on the bottle neck.

* * * * *